US006725770B2

(12) United States Patent
Maeda

(10) Patent No.: US 6,725,770 B2
(45) Date of Patent: Apr. 27, 2004

(54) HYBRID PRINTING APPARATUS AND RELATED CONTROL METHOD

(75) Inventor: Yukihiro Maeda, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/293,486

(22) Filed: Nov. 14, 2002

(65) Prior Publication Data

US 2003/0095823 A1 May 22, 2003

(30) Foreign Application Priority Data

Nov. 21, 2001 (JP) ..... P2001-356361

(51) Int. Cl.[7] ..... B41M 1/12

(52) U.S. Cl. ..... 101/129; 101/118; 101/127; 101/485; 347/104; 399/2

(58) Field of Search ..... 101/485, 118, 101/129, 127; 347/104; 399/2

(56) References Cited

U.S. PATENT DOCUMENTS 5,321,467 A * 6/1994 Tanaka et al. ..... 399/2
5,373,350 A * 12/1994 Taylor et al. ..... 399/2
5,561,500 A * 10/1996 Ohzeki et al. ..... 399/85
5,781,823 A * 7/1998 Isobe et al. ..... 399/2
5,980,136 A * 11/1999 Teumer et al. ..... 400/521
6,151,037 A * 11/2000 Kaufman et al. ..... 347/2
6,249,303 B1 * 6/2001 Mochizuki et al. ..... 347/222

FOREIGN PATENT DOCUMENTS

JP 08-197824 8/1996
JP 09131930 A * 5/1997 ..... B41J/3/54
JP 11-248385 * 12/1999 ..... B41J/29/38

* cited by examiner

*Primary Examiner*—Andrew H. Hirshfeld
*Assistant Examiner*—Andrea H. Evans
(74) *Attorney, Agent, or Firm*—Nath & Associates PLLC; Marvin C. Berkowitz

(57) ABSTRACT

A hybrid printing apparatus and related control method have a first print section 1*a* composed of a plurality of printing machines located in parallel to one another, and a second print section 1*b* composed of one printing machine and connected to the first print section, via a print medium transfer section 1*c* having a transfer passage 31 composed of discrete passage components which include change-over rollers 32 to change over start/stop operations in transfer of print media and medium detection sensors 33 to detect leading edges of the print media discharged from the respective printing machines of the first print section 1*a*, respectively. A control section 1*d* controls timings at which the change-over rollers 32 are changed over, so as to sequentially transfer the printing media from the first section 1*a* to the second print section 1*b* in response to detection signals from the medium detection sensors 33.

6 Claims, 3 Drawing Sheets

HYBRID PRINTING APPARATUS AND RELATED CONTROL METHOD

BACKGROUND OF THE INVENTION

The present invention relates to a printing apparatus which permits characters and/or images to be reproduced on print medium in dependence on print data and, more particularly, a so-called hybrid printing apparatus and a related control method in which the printing apparatus is composed of a plurality of printing machines that are operated in printing systems mutually different from one another.

Attempts have heretofore been made in the past for providing printing machines of various print types, that permit characters and/or images to be reproduced on print medium in dependence on print data, such as a printing machine of an ink-jet type with a print head formed with an ejection nozzle for ejecting ink onto print medium to be adhered thereto for thereby performing printing operation, or a stencil printing machine with a printing drum on which a stencil sheet made according to print data is wrapped around and which is rotated to allow ink supplied from an inside area of the printing drum to be transferred onto print medium via a perforated portion of the stencil sheet to perform the printing operation.

The printing machines of these print types have respective advantages and disadvantages. For example, the printing machine of the ink-jet type has a capability of obtaining a high resolution image of full color and, in contrast, has an issue in which a relatively longer time period is required for completing print on one sheet of print medium. Further, for instance, the stencil printing machine completes print on one sheet of print medium each time the printing drum is rotated one revolution and, so, has a capability of executing print in a short time period at an extremely low cost to be advantageous especially when performing print in a large number of prints, but encounters an issue in which, when achieving print of a colored image, printing drums of respective colors must be prepared and complex stencil making operations are required for respective colors with a resultant difficulty in performing print of the full colored image in an actual practice.

To address such an issues, it is a usual practice to selectively employ the printing machines with their suitability for particular purposes, and, for instance, when performing print in a small number of prints with the color images, the printing machine of the inkjet type is used whereas, when performing print in a large number of prints with a monocolor, the stencil printing machine is used.

In recent years, studies have been undertaken to use a so-called hybrid printing apparatus in which a plurality of printing machines of different print types are combined to take advantages of respective effects to provide a particular printing machine that is enabled to perform print in an efficient way to comply with the various purposes. A detailed technology for realizing such a hybrid printing apparatus is, for instance, disclosed in Japanese Patent Application Laid-open No. 8-197824 in which the stencil printing machine is additionally provided with a print section to execute print in the ink-jet type to enable consecutive print in the stencil printing method and the ink-jet type.

SUMMARY OF THE INVENTION

However, since the printing apparatus disclosed in the above Japanese Patent Application Laid-open No. 8-197824 has a structure in which one print section for executing print in the ink-jet type is disposed over a sheet discharge path of the print section to perform the stencil printing operation, a total print time interval is determined based on a processed time interval at the print section that executes print in the ink-jet type, resulting in an issue with no capability of fully taking an advantage of high speed print in the stencil printing machine.

As one technique to address such an issue, it is conceivable to be extremely effective to provide the stencil printing machine with a structure in which the plural printing machines of the ink-jet types, each of which has a longer print time interval than that of the stencil printing machine, are disposed in parallel to one another to permit these plural printing machines to simultaneously execute print in a parallel relationship whereupon print media, whose prints are terminated in the ink-jet processes, are then supplied to the stencil printing machine in a sequential manner to compel the stencil printing machine to consecutively perform print.

When realizing such an idealistic hybrid printing apparatus, it is important for the plural printing machines for performing print in the ink-jet process and the stencil printing machine to be maintained in an appropriate interlocking condition to appropriately control print media to be transferred so as to allow print media, whose prints have been terminated in the ink-jet process, to be transferred to the stencil printing machine in a good order.

However, when simultaneously performing print in the inkjet process in the parallel relationship with the plural printing machines and even when executing the printing operations with these printing machines based on common print data, time intervals required for the respective printing machines are not necessarily fixed owing to a difference in timings in which data is transferred to the respective printing machines or to the presence of particular services, such as a head cleaning service, to be discretely executed at irregular timings for the respective printing machines. As a result, an issue arises in which it is extremely difficult to execute control so as to transfer print media, whose prints have been terminated in the printing machines, to the stencil printing machine in a good sequential order one by one in coincidence with the timing at which print begins in the stencil printing machine.

The present invention has been completed with the above related art actual state circumstances in mind and has an object of the present invention to provide a hybrid printing apparatus and related control method for appropriately controlling delivery of print media between print sections of different print types to enable proper print at a high efficiency so as to comply with various purposes.

According to a first aspect of the present invention, there is provided a hybrid printing apparatus comprising a first print section including a plurality of printing machines which are located in parallel, a second print section including one printing machine whose printing speed is higher than that of the printing machine forming the first print section, and a medium transfer section for transferring print media from the first print section to the second print section and including a medium transfer passage having discrete passage components located in the first print section side for the plural printing machines, respectively, and collected in one passage in the second print section side, a plurality of change-over rollers disposed in the discrete passage components of the medium transfer passage, respectively, for changing over start/stop operations in transfer of print media, discharged from the respective plural printing machines, with respect to the second print section, and a plurality of medium detection sensors disposed in the discrete passage components of the medium transfer passage in close proximity to the plural change-over rollers, respectively, to detect leading edges of the print media discharged from the plural printing machines, respectively, and a control section for controlling entire operations of the printing apparatus, wherein the control section controls timings at which the plural change-over rollers are changed over in response to detection signals delivered from the plural medium detection sensors.

According to a second aspect of the present invention, there is provided a hybrid printing apparatus, wherein the control section controls the timings, at which the plural change-over rollers of the medium transfer section are changed over, so as to allow only one print medium to be transferred to the medium transfer passage of the medium transfer section.

According to a third aspect of the present invention, there is provided a hybrid printing apparatus, wherein the plural medium detection sensors of the medium transfer section are disposed at positions, that are separated from associated print medium discharge positions of the printing machines of the first print section, by values greater than the maximum dimension of the print media available for print, and the plural change-over rollers of the medium transfer section are disposed at positions between the print medium discharge positions of the printing machines of the first print section and the associated medium detection sensors, respectively.

According to a fourth aspect of the present invention, there is provided a hybrid printing apparatus, wherein the control section controls a timing, at which the print medium is supplied to the second print section, and a timing, at which the print medium, whose print has been terminated at the first print section, begins to be transferred to the second print section, in synchronism with respect to one another and controls a transfer speed of the medium transfer section such that a required transfer time interval, in which the print medium is transferred with the medium transfer section, is less than a unit print time interval of the second print section.

According to a fifth aspect of the present invention, there is provided a hybrid printing apparatus, wherein the control section controls the timings, at which the plural change-over rollers of the medium transfer section are changed over, at a time interval greater than a required transfer time interval in which the print medium is transferred with the medium transfer section.

According to a sixth aspect of the present invention, there is provided a method of controlling a hybrid printing apparatus which has a first print section including a plurality of printing machines which are located in parallel, a second print section including one printing machine whose printing speed is higher than that of the printing machine forming the first print section, and a medium transfer section for transferring print media from the first print section to the second print section and including a medium transfer passage having discrete passage components located in the first print section side for the plural printing machines, respectively, and collected in one passage in the second print section side, a plurality of change-over rollers disposed in the discrete passage components of the medium transfer passage, respectively, for changing over start/stop operations in transfer of print media, discharged from the respective plural printing machines, with respect to the second print section, and a plurality of medium detection sensors disposed in the discrete passage components of the medium transfer passage in close proximity to the plural change-over rollers, respectively, to detect leading edges of the print media discharged from the plural printing machines, respectively, the method comprising controlling timings, at which the plural change-over rollers of the medium transfer section are changed over, at a time interval greater than a required transfer time interval, in which the print medium is transferred with the medium transfer section, in response to detection signals delivered from the plural detection sensors, and controlling a timing, at which the print medium is supplied to the second print section, and a timing, at which the print medium, whose print has been terminated at the first print section, begins to be transferred to the second print section, in synchronism with respect to one another and controls a transfer speed of the medium transfer section such that a required transfer time interval, in which the print medium is transferred with the medium transfer section, is less than a unit print time interval of the second print section in response to the detection signals delivered from the detection sensors.

DETAILED DESCRIPTION OF THE PREFERRED EMBODIMENT

Figure 1:
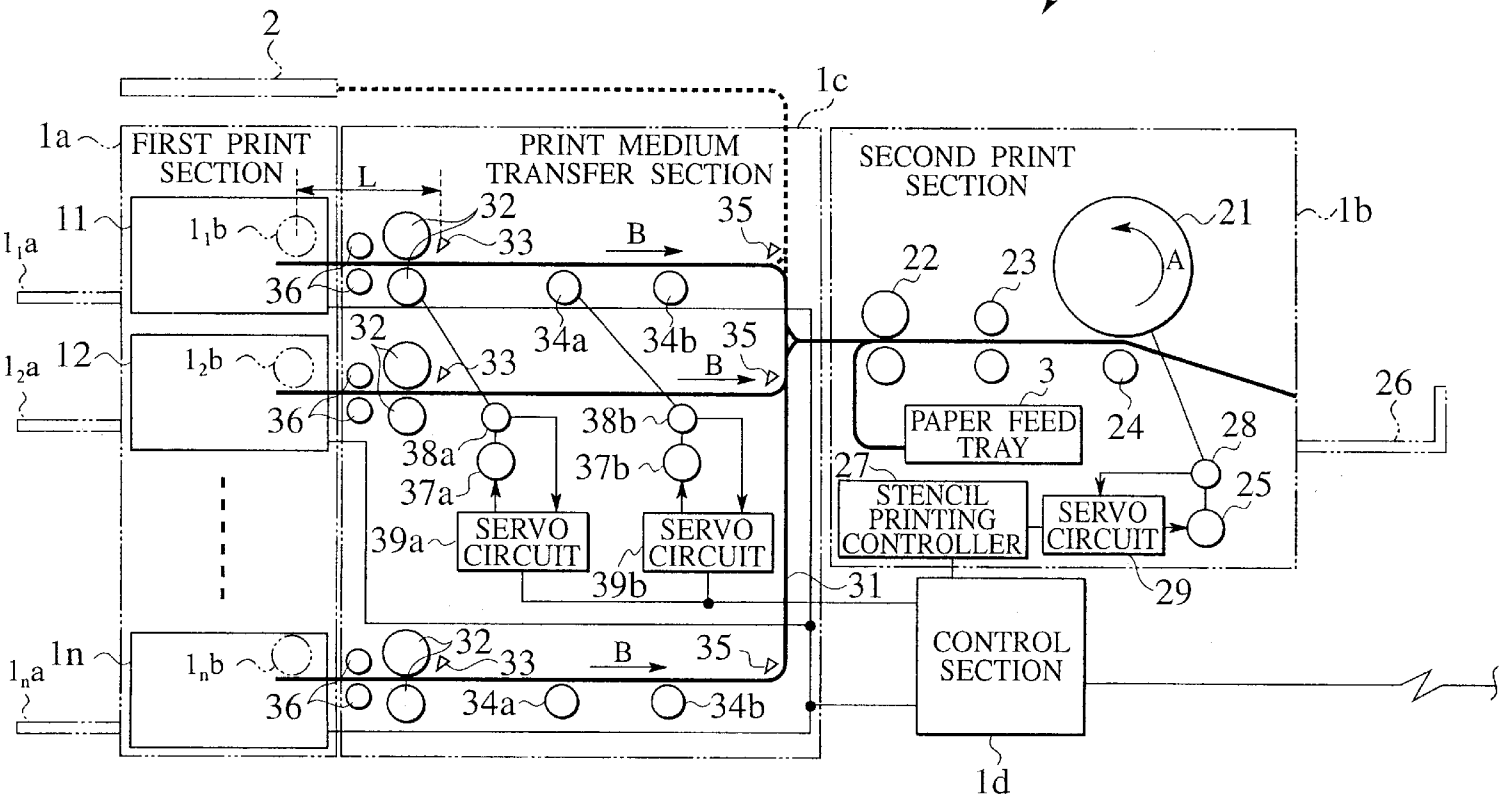
FIG. 1 is a typical overall structural view of a hybrid printing apparatus according to the present invention.

Referring to the drawings, a hybrid printing apparatus of an embodiment according to the present invention is described below in detail.

An overall structure of the hybrid printing apparatus to which the present invention is applied is typically shown in FIG. 1.

As shown in FIG. 1, the hybrid printing apparatus 1 is comprised of a first print section 1*a*, a second print section 1*b*, a print medium transfer section 1*c* and a control section 1*d*.

The first print section 1*a* is comprised of a plurality of printing machines $\mathbf{1}_1, \mathbf{1}_2, \ldots \mathbf{1}_n$ which are located in parallel to one another. Each of the respective printing machines $\mathbf{1}_1, \mathbf{1}_2, \ldots \mathbf{1}_n$ forming the first print section 1*a* includes, for instance, an ink-jet type printing machine. Although the ink-jet type printing machine takes a relatively long time interval (hereinafter referred to as a unit print time) necessary for completing print on a sheet of print medium, it has a capability of obtaining a high resolution colored characters and/or images. While, in the presently filed embodiment, the hybrid printing apparatus is described with reference to an example in which the ink-jet printing machines are employed as the respective printing machines $\mathbf{1}_1, \mathbf{1}_2, \ldots \mathbf{1}_n$ that form the first print section 1*a*, it is to be noted that the respective printing machines $\mathbf{1}_1, \mathbf{1}_2, \ldots \mathbf{1}_n$ forming the first print section 1*a* are not intended to be limited to the particular ink-jet printing machines and may be comprised of other printing machines of every types.

When data (hereinafter referred to as first data) among print data of objects to be printed, regarded by the control section 1*d* to be suited for being processed with the first print section 1*a*, is transmitted from the control section 1*d*, the respective printing machines $1_1$, $1_2$, . . . of the first print section 1*a* execute printing operation in dependence on such first data, i.e., for instance, to allow colored characters andlor images to be reproduced on print medium.

More particularly, if first data is transmitted to the respective printing machines $1_1$, $1_2$, . . . $1_n$, which forms the first print section 1*a*, from the control section 1*d*, the respective printing machines $1_1$, $1_2$, . . . $1_n$, forming the first print section 1*a*, are supplied with print media from paper feed trays $1_1a$, $1_2a$, . . . $1_na$, respectively, which are associated with the printing machines $1_1$, $1_2$, . . . $1_n$, respectively, to permit respective print heads to scan correlated print media to cause ink, ejected from the correlated print heads in response to first data, to be adhered to the respective print media which are consequently reproduced with characters andlor images in color in dependence on first data. Then, the respective printing machines $1_1$, $1_2$, . . . $1_n$, forming the first print section 1*a*, discharge the respective print media, which are furnished with print, to the print medium transfer section 1*c* side via sheet discharge rollers $1_1b$, $1_2b$, . . . $1_nb$, respectively.

Also, in a case where print data of the object to be printed is discriminated with the control section 1*d* to be involved in only first data suitable to be processed in the first print section 1*a* and a mode (hereinafter referred to as a first-print-section single mode) for executing printing operation at only the first print section 1*a* is selected, print media printed with the respective printing machines $1_1$, $1_2$, . . . are discharged via the print medium transfer section 1*c* to a paper receiving tray 2 specifically prepared for the first print section 1*a*.

The second print section 1*b* is comprised of one set of a stencil printing machine which performs print at a higher speed than those of the respective printing machines $1_1$, $1_2$, . . . $1_n$ which forms the first print section 1*a*. Also, while the present invention is described with reference to an example in which the stencil printing machine is used as the printing machine forming the second print section 1*b*, the printing machine which forms the second print section 1*b* may not be limited to the stencil printing machine and printing machines of all kinds of print types may be applied to the printing machine of the second print section 1*b* provided that a printing speed is higher than those of the respective printing machines $1_1$, $1_2$, . . . $1_n$ which form the first print section 1*a*.

When data (hereinafter referred to as second data) among print data of the objects to be printed, regarded by the control section 1*d* to be suited for being processed with the second print section 1*b*, is transmitted from the control section 1*d*, the stencil printing machine forming the second print section 1*b* executes printing operation in dependence on such second data, i.e., for instance, to allow monocolor characters and/or images to be reproduced on print medium.

More particularly, upon receipt of second data from the control section 1*d*, first, the stencil printing machine which forms the second print section 1*b* performs stencil making operation to allow a stencil sheet to be formed with a perforated image pattern in dependence on second data whereupon the stencil sheet formed with the perforated image pattern is wrapped around an outer peripheral surface of a printing drum 21. And, when print medium whose print has been completed with the first print section 1*a* is supplied via the print medium transfer section 1*c*, this print medium is fed into the second print section 1*b* at a given timing via a paper feed roller pair 22 and a timing roller pair 23 to cause print medium to be nipped between the printing drum 21, wrapped with the stencil sheet, and a press roller 24. Under such a condition, driving a motor 25 to rotate the printing drum 21 in a direction as shown by an arrow A to cause ink, supplied from an inner part of the printing drum 21, to be transferred to print medium via perforated portion of the stencil sheet enables print medium to be reproduced with the characters and/or images in the monocolor. Then, the stencil printing machine forming the second print section 1*b* discharges print medium furnished with print to a paper receiving tray 26.

Also, when print data is discriminated with the control section 1*d* to be composed of only second data suited for print with the second print section 1*b* and a mode (hereinafter referred to as a second-print-section single mode) to execute printing operation only at the second print section 1*b* is selected, the stencil printing machine forming the second print section 1*b* is supplied with print medium from a paper feed tray 3, specifically located for the second print section 1*b*, to allow print medium to be reproduced with the characters and/or images in the monocolor in dependence on second data whereupon print medium is discharged to the paper receiving tray 26.

With the stencil printing machine forming such a second print section 1*b*, the basic sequence of a series of printing operations set forth above is controlled with a stencil printing controller 27 adapted to receive control signals and second data from the control section 1*d*. Further, the stencil printing machine is comprised of a drum encoder 28 which produces pulse signals in dependence on a angle of rotation of the printing drum 21, and a servo circuit 29 responsive to the pulse signals from the drum encoder 28 for controllably drive of the motor 25, thereby permitting the servo circuit 29 to controllably drive the motor 25 to cause the printing drum 21 to rotate in a stable state.

Especially, such a stencil printing machine is configured to perform one printing cycle for a single sheet of print medium every one rotation of the printing drum 21, the printing speed depends on the rotational speed of the printing drum 21 and has a structure to change over the rotational speed of the printing drum 21, i.e., the printing speed of the stencil printing machine, in a stepwise manner within a given speed range. The change-over of such a printing speed is performed with the stencil printing controller 27 through control of the servo circuit 29 in response to the control signal from the control section 1*d*.

The print medium transfer section 1*c* serves to transfer print media, whose prints are completed with the first print section 1*a*, to the second print section 1*b*. The print medium transfer section 1*c* is comprised of a transfer passage 31 serving as traveling paths of print media, a plurality of change-over roller pairs 32 located in the transfer passage 31 of the first print section 1*a* side for the printing machines $1_1$, $1_2$, . . . $1_n$ forming the first print section 1*a*, respectively, a medium detection sensors 33 disposed in close proximity to the change-over roller pairs 32, respectively, a plurality of sets of transfer rollers 34*a*, 34*b* disposed in midways of the transfer passage 31, jam detection sensors 35 disposed in midways of the transfer passage 31, and a plurality of intermediate roller pairs 36 disposed between sheet discharge rollers $1_1b$, $1_2b$, . . . $1_nb$ of the respective printing machines $1_1$, $1_2$, . . . $1_n$, which form the first print section 1*a*, and the plural change-over roller pairs 32, respectively.

The transfer passage 31 is structured with passage components shown in a solid line and a passage component shown in a dotted line in FIG. 1. In particular, the transfer passage 31 has a structure in which discrete passage components, shown by the solid line, are disposed in the first print section 1 a side and connected to the printing machines $\mathbf{1}_1$, $\mathbf{1}_2$, . . . $\mathbf{1}_n$, of the first print section 1*a*, respectively, with trailing ends of these discrete passage components being collectively joined into one transfer path at a position closer to the second print section 1*b* side and connected thereto.

Print media discharged from the respective printing machines $\mathbf{1}_1$, $\mathbf{1}_2$, . . . $\mathbf{1}_n$ forming the first print section 1*a* are guided with the transfer passage 31 and sequentially fed to the paper feed roller pair 22 of the second print section 1*b*.

The passage component, shown by the dotted line in FIG. 1, designates a path through which print media, whose prints are completed with the first print section 1*a* in the first-print-section single mode, are discharged to the paper receiving tray 2. The print medium transfer section 1*c* is structured such that when the first-print-section single mode is selected, the path through which print media, whose prints are completed with the first print section 1*a*, are transferred, are switched over to the passage component shown by the dotted line by means of a passage change-over means (not shown) located in midways of the transfer passage 31 shown by the solid line in FIG. 1.

The change-over roller pairs 32 of the respective printing machines $\mathbf{1}_1$, $\mathbf{1}_2$, . . . $\mathbf{1}_n$ forming the first print section 1*a* serve to execute change-over between a start-up and a stop for transferring print media, discharged from the respective printing machines $\mathbf{1}_1$, $\mathbf{1}_2$, . . . forming the first print section 1*a*, to the second print section 1*b* for thereby controlling timings at which print media, discharged from the respective printing machines $\mathbf{1}_1$, $\mathbf{1}_2$, . . . $\mathbf{1}_n$ forming the first print section 1*a*, are fed to the second print section 1*b* side and, to this end, the change-over roller pairs 32 are disposed between the sheet discharge rollers $\mathbf{1}_1b$, $\mathbf{1}_2b$, . . . $\mathbf{1}_nb$, of the printing machines $\mathbf{1}_1$, $\mathbf{1}_2$, . . . $\mathbf{1}_n$ forming the first print section 1*a*, and the medium detection sensors 33, respectively.

More particularly, the change-over roller pairs 32 include pairs of upper and lower rollers disposed in an opposed relationship, with one of each roller pair being connected to a motor 37*a* via a clutch which is not shown. With such an arrangement, the change-over roller pairs 32 are operative to rotate responsive to driving force of the motor 37*a* when the clutch is turned on under the control of the control section 1*d* so as to permit print media, discharged from the respective printing machines $\mathbf{1}_1$, $\mathbf{1}_2$, . . . $\mathbf{1}_n$ forming the first print section 1*a* and nipped between relevant roller pairs, to be fed to the second print section 1*b* side. Also, the motor 37*a* for driving the change-over roller pairs 32 is controlled to rotate at a constant speed with the servo circuit 39*a* in response to the pulse signals delivered from the encoder 38*a*.

The medium detection sensors 33 disposed in the discrete passage components of the transfer passage 31 at respective midway positions in the vicinities of the change-over roller pairs 32 serve to detect leading edges of print media discharged from the respective printing machines $\mathbf{1}_1$, $\mathbf{1}_2$, . . . $\mathbf{1}_n$ forming the first print section 1*a*. As the respective medium detection sensors 33 detect the leading edges of the print media discharged from the respective printing machines $\mathbf{1}_1$, $\mathbf{1}_2$, . . . $\mathbf{1}_n$ forming the first print section 1*a*, the medium detection sensors 33 produce detection signals which are transmitted to the control section 1*d*. Thus, the control section 1*d* is enabled to recognize a particular printing machine, among other printing machines forming the first print section 1*a*, which has completed printing operation. And, the control section 1*d* is configured to have a memory which stores the numbers of the medium detection sensors 33 from which the detection signals are transmitted, or the identification numbers of the printing machines $\mathbf{1}_1$, $\mathbf{1}_2$, . . . $\mathbf{1}_n$ associated with the respective medium detection sensors 33, i.e., the identification numbers of the particular printing machines, among the respective printing machines forming the first print section 1*a*, that have completed the printing operation, in due order in which the medium detection sensors have detected.

The respective medium detection sensors 33 are located at positions such that distances between the sensors 33 and the print medium discharge positions of the respective printing machines $\mathbf{1}_1$, $\mathbf{1}_2$, . . . $\mathbf{1}_n$ forming the first print section 1*a* and, in particular, a distance L between each of the sheet discharge rollers $\mathbf{1}_1b$, $\mathbf{1}_2b$, . . . $\mathbf{1}_nb$ and each of the medium detection sensors 33 have a value greater than the maximum dimension of the print medium that is able to be printed. With such an arrangement, the respective medium detection sensors 33 are enabled to reliably detect the leading edges of respective print media, whose prints are completed at the respective printing machines $\mathbf{1}_1$, $\mathbf{1}_2$, . . . $\mathbf{1}_n$ forming the first print section 1*a* and which are discharged to the transfer passage 31, respectively, without detecting print media in the course of printing operations executed with the respective printing machines $\mathbf{1}_1$, $\mathbf{1}_2$, . . . $\mathbf{1}_n$ forming the first print section 1*a*.

The plurality of sets of transfer rollers 34*a*, 34*b*, which are disposed in midways of the transfer passage 31, serve to transfer print media, fed out from the change-over roller pairs 32, to the second print section 1*b*. The transfer rollers 34*a*, 34*b* are consecutively disposed in midway of the transfer passage 31 under a pitch less than a minimum dimension of print medium that is able to be printed, with respective transfer rollers 34*a*, 34*b* being connected to a motor 37*b*. And, the transfer rollers 34*a*, 34*b* rotate responsive to driving force of the motor 37*b* and, due to a rotating force, print media fed out from the change-over roller pairs 32 are transferred to the second print section 1*b*. While, in the embodiment shown in FIG. 1, the first print section 1*a* has been shown as including two rollers 34*a*, 34*b*, for convenience, in the discrete passage for each of the respective printing machines $\mathbf{1}_1$, $\mathbf{1}_2$, . . . $\mathbf{1}_n$ forming the first print section 1*a*, it is to be noted that the number of these transfer rollers 34*a*, 34*b* may be suitably determined in dependence on the length of the transfer passage 31. Further, rotational speed of the motor 37*b* for driving the transfer rollers 34*a*, 34*b* is controlled with the servo circuit 39*b* in response to the pulse signals delivered from the encoder 38*b*.

The jam detection sensors 35 disposed in midways of the transfer passage 31 serve to detect jams of print media in the transfer passage 31. As the jams of print media are detected with the jam detection sensors 35, detection signals produced by these sensors 35 are transmitted to the control section 1*d*. Thus, the control section 1*d* is able to instantaneously recognize the jams of print media present in the transfer passage 31 and to promptly take a desired step, involving a step of, for instance, interrupting the operation of the hybrid printing apparatus 1. Also, while the jam detection sensors 35 may be located at suitable positions in the transfer passage 31, the presence of the jam detection sensors 35 disposed on the discrete passage components enables the control section 1*d* to discriminate which passage component encounters the jam of the print medium.

The intermediate roller pairs 36, disposed in upstream of the change-over roller pairs 32 of the transfer passage 31, serve to transfer print media, whose prints are completed with the respective printing machines $\mathbf{1}_1$, $\mathbf{1}_2$, . . . $\mathbf{1}_n$ forming the first print section 1*a*, to the associated change-over roller pairs 32 and, to this end, are located between the sheet discharge rollers $\mathbf{1}_1b$, $\mathbf{1}_2b$, . . . $\mathbf{1}_nb$, of the respective printing machines $1_1$, $1_2$, . . . $1_n$ forming the first print section 1*a*, and the change-over roller pairs 32. The intermediate roller pairs 36 are arranged to rotate responsive to the driving force of a motor, which is not shown, when the rotational position of the printing drum 21 of the second print section 1*b* reaches a given angular position such that when print media, whose prints are completed with the respective printing machines $1_1$, $1_2$, . . . $1_n$ forming the first print section 1*a*, are discharged from the sheet discharge rollers $1_1b$, $1_2b$, . . . $1_nb$ to the transfer passage 31 of the print medium transfer section 1*c*, print media are transferred to the change-over roller pairs 32. Also, while the embodiment in FIG. 1 has been shown including intermediate roller pairs 36 disposed in the discrete passage components for convenience, the number of intermediate roller pairs 36 may be suitably determined in dependence on the dimensions of print media and the positions at which the change-over roller pairs 32 are disposed.

The print medium transfer section 1*c* with such a structure set forth above has a buffer function that temporarily holds print media discharged from the respective printing machines $1_1$, $1_2$, . . . $1_n$ forming the first print section 1*a*. Namely, print media, whose prints are completed with the respective printing machines $1_1$, $1_2$, . . . $1_n$ forming the first print section 1*a*, are discharged from the sheet discharge rollers $1_1b$, $1_2b$, . . . $1_nb$ to the transfer passage 31 of the print medium transfer section 1*c* and transferred to the change-over roller pairs 32 by means of the intermediate roller pairs 36. During such transfer movements, as the print media reach the associated change-over roller pairs 32, the leading edges of the relevant print media are detected with the medium detection sensors 33, respectively, which produce the detection signals, with the control section 1*d* being responsive to the detection signals of the medium detection sensors 33 to turn off the motor for driving the intermediate roller pairs 36 while temporarily turning off the clutches connected to the change-over roller pairs 32. During a time interval in which the clutches connected to the change-over roller pairs 32 are turned off, the respective leading edges of print media, whose prints are terminated with the respective printing machines $1_1$, $1_2$, . . . $1_n$ forming the first print section 1*a*, come to be halted at positions, closer to the second print section 1*b* side, slightly beyond the associated medium detection sensors 33 without being transferred to respective leading stages of the change-over roller pairs 32.

And, when it is detected that the rotational position of the printing drum 21 of the second print section 1*b* reaches the given angular position, the control section 1*d* controls so as to turn on the motor for driving the intermediate roller pairs 36 while turning on the clutches connected to the change-over roller pairs 32 to cause the change-over roller pairs 32 to rotate responsive to the driving force of the motor 37*a*. This causes print media, whose prints are completed with the respective printing machines $1_1$, $1_2$, . . . $1_n$ forming the first print section 1*a* and have the leading edges halted at the positions, closer to the second print section 1*b* side, slightly beyond the medium detection sensors 33, to be moved in a direction as shown by an arrow B in FIG. 1 and transferred to the second print section 1*b*.

Figure 2:
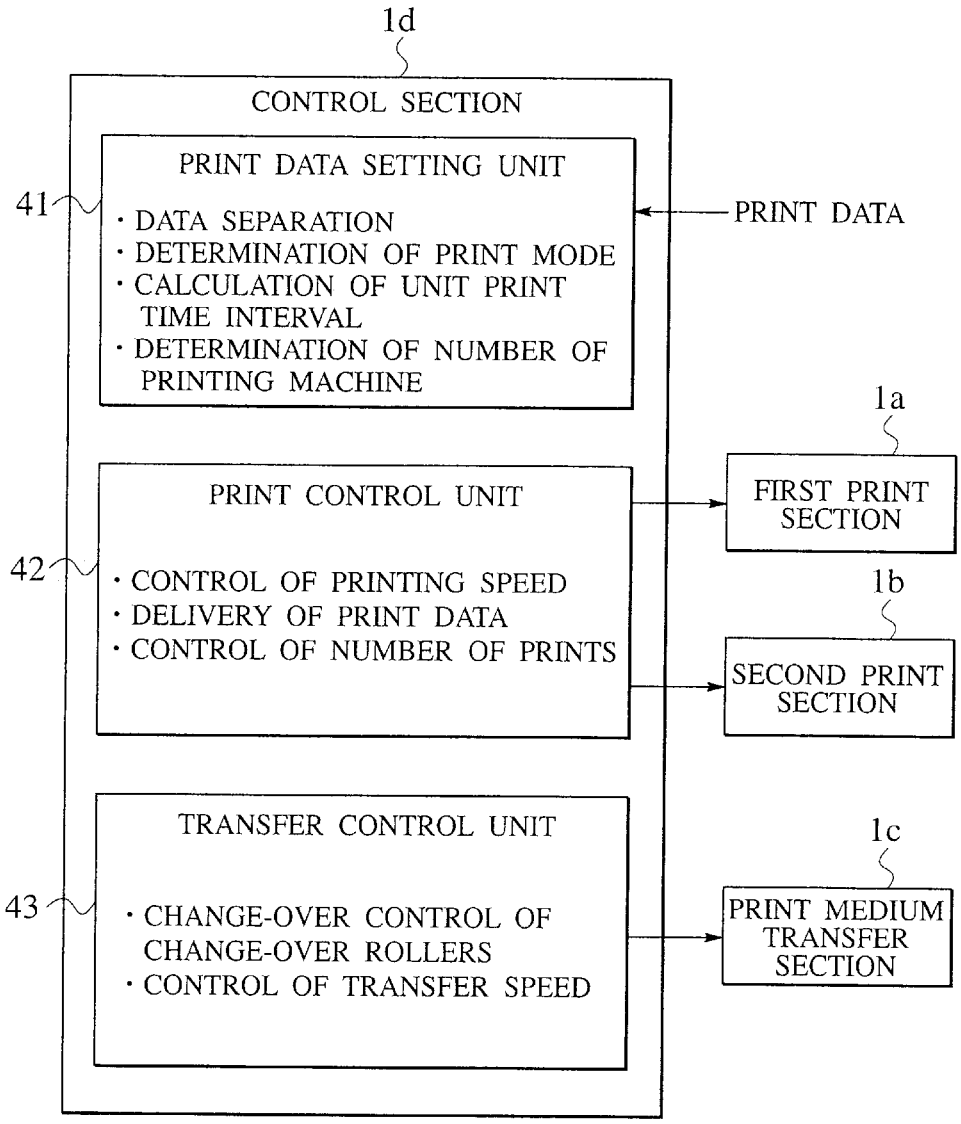
FIG. 2 is a functional block diagram of a control section of the hybrid printing apparatus shown in FIG. 1.

The control section 1*d* serves to control entire operation of the hybrid printing apparatus embodying the present invention. More particularly, the control section 1*d* operates to execute various functions, such as a function as a print data setting unit 41, a function as a print control unit 42 and a function as a transfer control unit 43 in a manner, for instance, as shown in a functional block diagram shown in FIG. 2 on the basis of a control program stored in a program memory.

The print data setting unit 41 performs data separation, mode settings, calculation of a printing time interval for the first print section 1*a*, and determination of the printing machines.

The data separation is executed to separate print data into first data suited for operation in the first print section 1*a* and second data suited for operation in the second print section 1*b*.

The mode setting is executed on the basis of print data to selectively set the first-print-section single mode to permit printing operations to be carried out with only the first print section 1*a*, the second-print-section single mode to permit printing operations to be carried out with only the second print section 1*b*, and an interlocking mode to allow the first print section 1*a* and the second print section 1*b* to be operated in an interlocking relationship to perform printing operations. Further, in response to the selected mode, the control section 1*d* executes change-over between the transfer passage 31 of the print medium transfer section 1*c* shown by the solid line in FIG. 1 and the transfer passage shown by the dotted line in FIG. 1.

The calculation of the printing time interval for the first print section 1*a* is executed to obtain a unit print time interval (Ti) required for print of one sheet of print medium to be carried out with the respective printing machines $1_1$, $1_2$, . . . $1_n$ forming the first print section 1*a*.

The determination of the printing machines is executed to determine the number of the printing machines to be operated, among the respective printing machines $1_1$, $1_2$, . . . $1_n$ forming the first print section 1*a*, in dependence on the unit print time and the number of designated print, and, on the basis of these factors, to determine the printing speed (Vr) of the second print section 1*b*.

Here, the printing speed (Vr) of the second print section 1*b* is expressed as (Vr)=1/(Tr), wherein (Tr) represents the unit print time of the second print section 1*b*.

The print control unit 42 serves to perform control of the printing speed, delivery of print data and control of the number of print.

The control of the printing speed is executed to control the printing speed (Vr) of the second print section 1*b* so as to cause the same to be aligned with the speed determined in a manner set forth above.

The delivery of print data is performed with a view to transmitting first data to an operative printing machine of the first print section 1*a* and second data to the second print section 1*b*. Here, transmission of first data is executed whenever the leading edges of print media are detected (i.e., when the print has been terminated at the relevant printing machine) with the medium detection sensors 33 of the print medium transfer section 1*c*. Further, transmission of second data is executed at a stage when the stencil making operation is carried out at the second print section 1*b*.

The control of the number of prints is executed to control the number of prints such that the number of prints at the termination of print is aligned with the designated number of prints. In particular, the designated number of prints is stored in the memory and, whenever first data is transmitted with respect to the operative printing machine of the first print section 1*a*, subtraction of such a numerical value is executed to allow transmission of first data to be continued until the numeric value reaches a value of "0". Then, it is discriminated that the designated number of prints has been completed under a condition where when a value of a print counter provided in the second print section 1*b* is read out, the print counter value of the second print section 1*b* coincides with the designated number of prints and a value of a transmission number counter (in which the designated number of prints is stored and a numeric value is subtracted whenever first print data is transmitted) reaches a value of "0". However, during the first-print-section single mode, since the second print section 1*b* is inoperative, a value of a paper discharge counter specifically provided in upstream of the paper receiving tray 2 is utilized in place of the value of the print counter of the second print section 1*b*. Further, during the second-print-section single mode, it is discriminated that the designated number of prints has been completed under a condition where the value of the print counter of the second print section 1*b* reaches the designated number of prints.

The transfer control unit 43 executes control of the change-over roller pairs 32 and control of the transfer speed.

The change-over control of the change-over roller pairs 32 is performed in a manner such that the memory stores the number of sequence in which the prints have been terminated in the first print section 1*a* correlated with the medium detection sensors 33, respectively, in response to the detection signals delivered from the medium detection sensors 33 located in the print medium transfer section 1*c* while detecting the timing at which the rotational position of the printing drum 21 of the second print section 1*b* reaches the given angular position to cause the particular change-over roller pair 32, correlated with the number of sequence, stored in the memory, in which the medium detection sensors 33 have been operated, to be driven for thereby permitting print media, whose prints have been terminated with the respective printing machines $\mathbf{1}_1$, $\mathbf{1}_2$, . . . $\mathbf{1}_n$ forming the first print section 1*a*, to be transferred to the second print section 1*b* side.

More in detail, as print media, whose prints have terminated in the respective printing machines $\mathbf{1}_1$, $\mathbf{1}_2$, . . . $\mathbf{1}_n$ forming the first print section 1*a*, are discharged onto the transfer passage 31 of the print medium transfer section 1*c*, print media are transferred with the intermediate roller pairs 36 and arrive at the associated change-over roller pairs 32. During travels of these print media, the leading edges of print media are detected with the correlated medium detection sensors 33, with the detection signals produced by the medium detection sensors 33 being transmitted to the control section 1*d*.

Upon receipt of the detection signals delivered from the medium detection sensors 33, the control section 1*d* discriminates that the particular printing machine, among the printing machines $\mathbf{1}_1$, $\mathbf{1}_2$, . . . $\mathbf{1}_n$ forming the first print section 1*a*, to which the particular medium detection sensor 33 serving as a source of transmitted detection signal is correlated, has terminated the printing operation, thereby turning off the motor for driving the particular intermediate roller pair 36 while turning off the associated clutch of the particular change-over roller pair 32. With such control, the particular print medium arriving at the correlated change-over roller pair 32 is prevented from being fed to downstream of the transfer passage 31 by means of such change-over roller pair 32, with the leading edge of such print medium being halted at the position, closer to the second print section 1*b* side, slightly beyond the correlated medium detection sensor 33.

Further, whenever the control section 1*d* receives the detection signals from the medium detection sensors 33, the control section 1*d* operates to store the number of the medium detection sensors 33 which have transmitted the medium detection signals or the identification numbers of the printing machines correlated with the medium detection sensors 33 in the memory in due order in which print media are detected with the correlated medium detection sensors 33.

Then, the control section 1*d* obtains the timing, at which the rotational position of the printing drum 21 of the second print section 1*b* reaches the given angular position, from the stencil printing controller 27 and turns on the motors for driving the intermediate roller pairs 36, correlated with the respective printing machines $\mathbf{1}_1$, $\mathbf{1}_2$, . . . $\mathbf{1}_n$ forming the first print section 1*a*, in due order in which the memory stores while compelling the clutches associated with the change-over roller pairs 32 to be turned on to render the relevant change-over roller pairs 32 to be operative. Thus, print media, whose prints are completed with the first print section 1*a* with the leading edges remaining stationary at the positions, closer to the second print section 1*b* side, slightly beyond the medium detection sensors 33, are moved to downstream of the transfer passage 31 to be transferred to the second print section 1*b* in the sequential fashion.

During such operations, the control section 1*d* controls the timings at which the change-over roller pairs 32 are changed over in order to preclude the plural print media to be simultaneously transferred through the transfer passage 31 of the print medium transfer section 1*c*. In particular, the control section 1*d* controls the change-over timings so as to prevent the clutches of the plural change-over roller pairs 32 from being turned on during the time interval less than a given transfer time interval (Th) that is determined by the transfer speed (Vh) of the print medium transfer section 1*c* and a transfer length of the transfer passage 31. Due to such control, it is possible to forestall an unfavorable probability of occurrence of the plural sheets of print media being simultaneously fed to the second print section 1*b* to cause the jam to occur at the position in the vicinity of the paper feed roller pair 22 of the second print section 1*b*.

The transfer speed control is executed to determine the transfer speed (Vh) of the print medium transfer section 1*c* and controllably drive the transfer rollers 34*a*, 34*b* to maintain such a transfer speed (Vh). In this connection, it is to be noted that the transfer speed (Vh) of the print medium transfer section 1*c* is expressed by (Vh)=(Lh)max/(Th), wherein (Lh)max designates the transfer length (the maximum transfer length between the medium detection sensor 33 and the paper feed roller pair 22 of the second print section 1*b*) of the transfer passage 31, and (Lh) designates the required time interval for transferring print media from the medium detection sensors 33 to the paper feed roller pair 22 of the second print section 1*b*.

Here, the control section 1*d* determines the transfer speed (Vh) of the print medium transfer section 1*c* so as to satisfy a formula expressed by the required transfer time interval (Th)≦the unit print time interval (Tr) of the second print section 1*b* by establishing a synchronized condition between the timing at which print medium is supplied to the paper feed roller pair 22 of the second print section 1*b*, i.e., the timing at which the timing roller pair 23 of the second print section 1*b* is operatively driven, and the timing at which print medium, whose print has been terminated at the first print section 1*a*, begins to be transferred to the second print section 1*b*, i.e., the timing at which the change-over roller pair 32 of the print medium transfer section 1*c* is driven. Then, the control section 1*d* controllably drives the transfer rollers 34*a*, 34*b* so as to maintain the transfer speed (Vh) determined in such a manner set forth above. Under such control, print media whose prints have been terminated in the first print section 1*a* are consecutively supplied in synchronism with rotation of the printing drum 21 of the second print section 1*b* in a sequential fashion.

Figure 3:
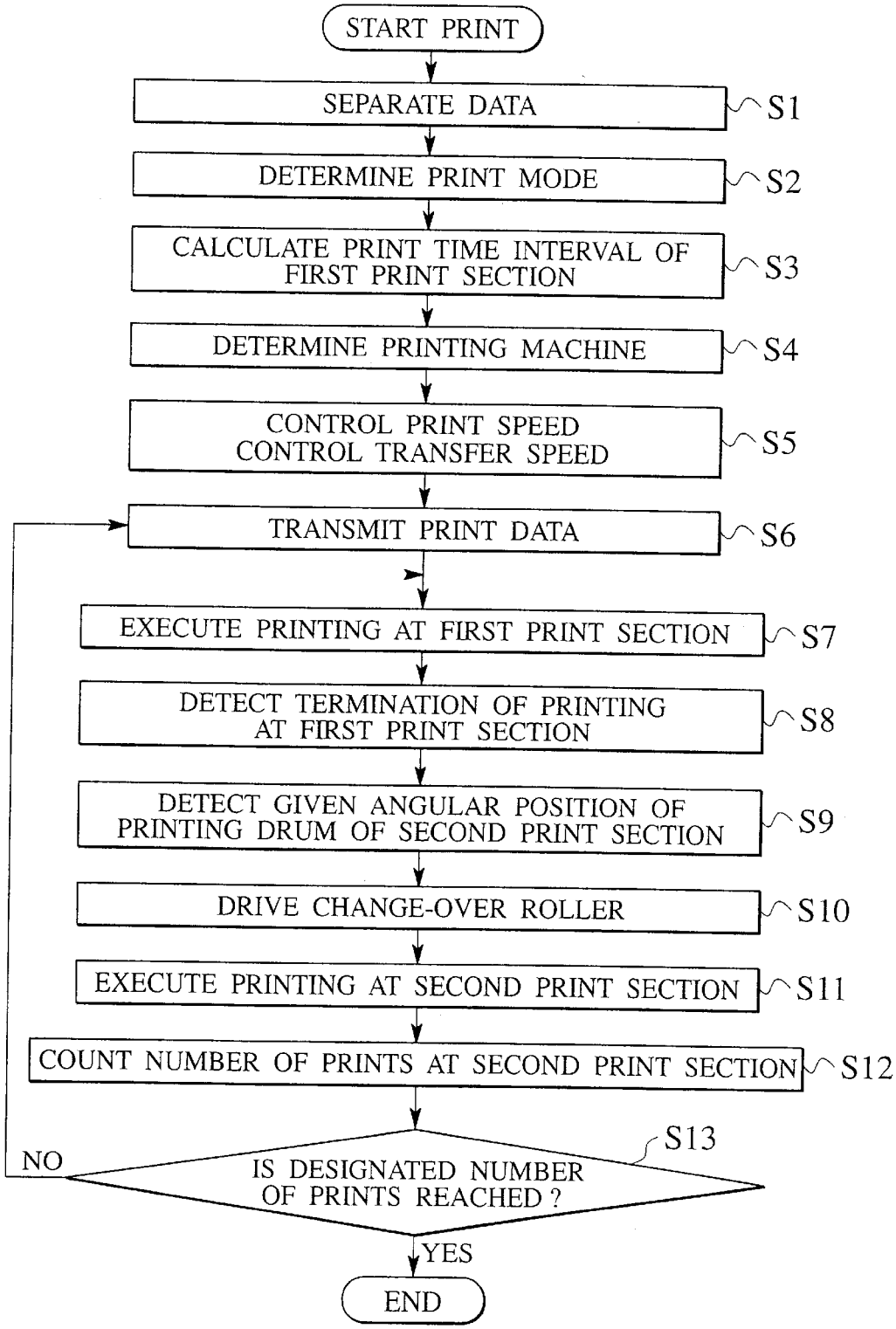
FIG. 3 is a flowchart for schematically illustrating the basic sequence of a series of printing operations to be executed in the hybrid printing apparatus shown in FIG. 1.

The hybrid printing apparatus 1 with such a structure set forth above is configured to automatically select the first-print-section single mode to permit the first print section 1*a* to be singly operative for executing the printing operation, the second-print-section single mode to permit the second print section 1*b* to be singly operative for executing the printing operation, the interlocking mode to permit the first print section 1*a* and the second print section 1*b* to be operative in the interlocking manner for executing the printing operation, in dependence on print data and, hereinafter, sequential flow of printing operations in the interlocking mode of the hybrid printing apparatus 1 is briefly described below with reference to a flowchart of FIG. 3.

First, in step S1, the print data setting unit 41 of the control section 1*d* operates to separate print data of the object to be printed into first data suited for the printing operation to be executed with the first print section 1*a* and second data suited for the printing operation to be executed with the second print section 1*b*. Here, print data of the object to be printed is transmitted from, for instance, an external unit such as a personal computer connected to the hybrid printing apparatus 1 and is received with the control section 1*d*.

In next step S2, the print data setting unit 41 of the control section 1*d* operates to determine the print mode on the basis of the result of data separating operation. Here, a detailed description is given below in conjunction with a case where print data of the object to be printed is separated into first and second data through the data separation process and the interlocking mode is selected.

In consecutive step S3, the print data setting unit 41 of the control section 1*d* operates to calculate the unit print time interval (Ti) on the basis of first data separated through the data separation process.

In succeeding step S4, the print data setting unit 41 of the control section 1*d* executes a process for determining the printing machine, i.e., a process for determining the number of the operative printing machine of the first printing section 1*a* and the printing speed (Vr) of the second print section 1*b*.

In subsequent step S5, the print data control unit 42 of the control section 1*d* executes to control the rotational speed of the printing drum 21 of the second print section 1*b* to cause the printing speed (Vr) of the second print section 1*b* to be aligned with the speed determined at the step S4. Further, the transfer control unit 43 of the control section 1*d* controls the transfer speed (Vh) of the print medium transfer section 1*c*, that is, the rotational speeds of the transfer rollers 34*a*, 34*b*, so as to compel the required transfer time interval (Th) of the print medium transfer section 1*c* to be maintained at a value less than the unit print time interval (Tr) of the second print section 1*b*.

In next step S6, the print control unit 42 of the control section 1*d* executes to transmit first and second data to the operative printing machine of the first print section 1*a* and the second print section 1*b*, respectively. When this occurs, the number of times in which first data is transmitted to the operative printing machine of the first print section 1*a* is counted.

In consecutive step S7, the operative printing machine of the first print section 1*a* executes to print on print medium through the use of an ink-jet type.

In succeeding step S8, the print control unit 42 of the control section 1*d* operates to recognize the termination of the printing operations at the relevant printing machines $\mathbf{1}_1$, $\mathbf{1}_2$, . . $\mathbf{1}_n$ of the first print section 1*a* in response to the detection signals transmitted from the medium detection sensors 33 of the print medium transfer section 1*c*. When this takes place, the memory stores the number of sequence, in which the relevant printing machines $\mathbf{1}_1$, $\mathbf{1}_2$, . . . $\mathbf{1}_n$ have terminated respective printing operations, in due order in which the detection signals are transmitted from the print medium detection sensors 33.

In subsequent step S9, the transfer control unit 43 of the control section 1*d* operates to detect the timing at which the rotational position of the printing drum 21 of the second print section 1*b* reaches the given angular position.

In next step S10, the transfer control unit 43 of the control section 1*d* drives the relevant change-over roller pair 32 associated with the printing machine, among the printing machines that have terminated the printing operations at the first print section 1*a*, which belongs to the earliest number of sequence, stored in the memory, in which the printing operations have performed. When this occurs, print media, whose prints are completed with the respective printing machines $\mathbf{1}_1$, $\mathbf{1}_2$, . . . $\mathbf{1}_n$ forming the first print section 1*a*, are transferred to the second print section 1*b* by means of the print medium transfer section 1*c*.

In consecutive step S11, the second print section 1*b* executes the operation to cause the stencil printing machine to print on print medium transferred from the operative printing machine of the first print section 1*a* via the print medium transfer section 1*c*.

In succeeding step S12, the print counter of the print control unit 42 of the control section 1*d* counts the number of prints that have been terminated at the second print section 1*b*.

In subsequent step S13, a determination is made by the print control unit 42 of the control section 1*d* to find whether the designated number of prints are terminated. More specifically, the determination as to whether the designated number of prints are terminated is executed to find if the print count value of the second print section 1*b* coincides with the designated number of prints and the value of the transmission number counter (in which the designated number of prints are stored and then count value is subtracted by 1 each time first print data is transmitted) is reached to 0 (zero). In this instance, if the judgment is made that the designated number of prints is not completed, flow is routed back to step S6 to perform the similar operations in a repeated cycle and if the judgment is made that the designated number of prints are completed, a series of printing operation in the interlocking mode is terminated.

As previously described above, with the hybrid printing apparatus 1 embodying the present invention, the presence of the print medium transfer section 1*c*, which transfers print medium from the first print section 1*a* to the second print section 1*b*, is configured to have the buffer function for temporarily retaining print media discharged from the respective printing machines $\mathbf{1}_1$, $\mathbf{1}_2$, . . . $\mathbf{1}_n$ forming the first print section 1*a* while compelling the relevant clutches of the change-over roller pairs 32 to be turned on or turned off through control of the control section 1*d* in response to the detection signals produced by the medium detection sensors 33 enables print media, discharged from the respective printing machines $\mathbf{1}_1$, $\mathbf{1}_2$, . . . $\mathbf{1}_n$ forming the first print section 1*a* and temporarily retained at the print medium transfer section 1*c*, to be consecutively fed to the second print section 1*b* in synchronism with the printing operation of the second print section 1*b*.

Accordingly, the hybrid printing apparatus 1 has a capability of consecutively supplying print media, whose prints are completed with the respective printing machines $\mathbf{1}_1$, $\mathbf{1}_2$, . . . $\mathbf{1}_n$ forming the first print section 1*a*, to the second print section 1*b* in a good sequential order while effectively absorbing unbalance in the print time interval among the respective printing machines $\mathbf{1}_1$, $\mathbf{1}_2$, . . . $\mathbf{1}_n$ forming the first print section 1*a*, enabling an interlocking relationship to be properly maintained between the first print section 1*a* and the second print section 1*b* to execute the printing operation at an extremely high speed in the most efficient way in compliance with a variety of print data.

Further, with the hybrid printing apparatus 1, the change-over control of the transfer of print media in the print medium transfer section 1*c* is executed by changing over the turned on or turned off states of the clutches of the change-over roller pairs 32 and, so, there is no need for a complex mechanism to be provided for changing over the transfer passages, resulting in a capability of an appropriate delivery of print media between the first print section 1*a* and the second print section 1*b* in a simplified structure.

The entire content of Japanese Application No. P2001-356361 with a filing date of Nov. 21, 2001 is herein incorporated by reference.

Although the present invention has been described above by reference to certain embodiments of the invention, the invention is not limited to the embodiments described above and modifications will occur to those skilled in the art, in light of the teachings. The scope of the invention is defined with reference to the following claims.

What is claimed is:

1. A hybrid printing apparatus comprising:

a first print section including a plurality of printing machines operable in parallel;

a second print section including one printing machine whose printing speed is higher than that of the printing machines forming the first print section; and a medium transfer section for transferring print media from the first print section to the second print section and including a medium transfer passage having discrete passage components located in the first print section side for the plural printing machines, respectively, and collected in one passage in the second print section side, a plurality of change-over rollers disposed in the discrete passage components of the medium transfer passage, respectively, for changing over start/stop operations in transfer of print media, discharged from the respective plural printing machines, with respect to the second print section, and a plurality of medium detection sensors disposed in the discrete passage components of the medium transfer passage in close proximity to the plural change-over rollers, respectively, to detect leading edges of the print media discharged from the plural printing machines, respectively; and a control section for controlling entire operations of the printing apparatus;

wherein the control section controls timings at which the plural change-over rollers are changed over in response to detection signals delivered from the plural medium detection sensors.

2. The hybrid printing apparatus according to claim 1, wherein the control section controls the timings, at which the plural change-over rollers of the medium transfer section are changed over, so as to allow only one print medium to be transferred to the medium transfer passage of the medium transfer section.

3. The hybrid printing apparatus according to claim 1, wherein the plural medium detection sensors of the medium transfer section are disposed at positions, that are separated from associated print medium discharge positions of the printing machines of the first print section, by values greater than a maximum dimension of the print media, and the plural change-over rollers of the medium transfer section are disposed at positions between the print medium discharge positions of the printing machines of the first print section and the associated medium detection sensors, respectively.

4. The hybrid printing apparatus according to claim 1, wherein the control section controls a timing, at which the print medium is supplied to the second print section, and a timing, at which the print medium, whose print has been terminated at the first print section, begins to be transferred to the second print section, in synchronism with respect to one another and controls a transfer speed of the medium transfer section such that a required transfer time interval, in which the print medium is transferred with the medium transfer section, is less than a unit print time interval of the second print section.

5. The hybrid printing apparatus according to claim 2, wherein the control section controls the timings, at which the plural change-over rollers of the medium transfer section are changed over, at a time interval greater than a required transfer time interval in which the print medium is transferred with the medium transfer section.

6. A method of controlling a hybrid printing apparatus which has a first print section including a plurality of printing machines operable in parallel, a second print section including one printing machine whose printing speed is higher than that of the printing machines forming the first print section, and a medium transfer section for transferring print media from the first print section to the second print section and including a medium transfer passage having discrete passage components located in the first print section side for the plural printing machines, respectively, and collected in one passage in the second print section side, a plurality of change-over rollers disposed in the discrete passage components of the medium transfer passage, respectively, for changing over start/stop operations in transfer of print media, discharged from the respective plural printing machines, with respect to the second print section, and a plurality of medium detection sensors disposed in the discrete passage components of the medium transfer passage in close proximity to the plural change-over rollers, respectively, to detect leading edges of the print media discharged from the plural printing machines, respectively, the method comprising:

controlling timings, at which the plural change-over rollers of the medium transfer section are changed over, at a time interval greater than a required transfer time interval, in which the print medium is transferred with the medium transfer section, in response to detection signals delivered from the plural detection sensors; and controlling a timing, at which the print medium is supplied to the second print section, and a timing, at which the print medium, whose print has been terminated at the first print section, begins to be transferred to the second print section, in synchronism with respect to one another and controls a transfer speed of the medium transfer section such that a required transfer time interval, in which the print medium is transferred with the medium transfer section, is less than a unit print time interval of the second print section in response to the detection signals delivered from the detection sensors.

* * * * *